United States Patent [19]

Kato

[11] Patent Number: 4,723,328

[45] Date of Patent: Feb. 9, 1988

[54] FLUIDIZED BEAD BED

[75] Inventor: Shigeya Kato, Kanagawa, Japan

[73] Assignee: Fuji Electric Co., Ltd., Kanagawa, Japan

[21] Appl. No.: 760,451

[22] Filed: Jul. 30, 1985

[51] Int. Cl.[4] ..... A47C 27/08

[52] U.S. Cl. ..... 5/453; 5/461; 5/495; 428/224; 428/229

[58] Field of Search ..... 5/423, 449–458, 5/461, 462, 468, 469, 473, 495; 128/33, 38; 428/224, 229, 242, 257–259

[56] References Cited

U.S. PATENT DOCUMENTS

| | | | |
|---|---|---|---|
| 3,097,962 | 7/1963 | Whitacre et al. | 428/288 |
| 3,428,973 | 2/1969 | Hargest et al. | 5/423 |
| 4,525,409 | 6/1985 | Elesh | 428/193 |
| 4,557,968 | 12/1985 | Thorton et al. | 428/229 |
| 4,606,968 | 8/1986 | Thorton et al. | 428/229 |

FOREIGN PATENT DOCUMENTS

| | | | |
|---|---|---|---|
| 2478985 | 10/1981 | France | 5/495 |

*Primary Examiner*—John E. Murtagh
*Assistant Examiner*—Andrew J. Rudy
*Attorney, Agent, or Firm*—Finnegan, Henderson, Farabow, Garrett and Dunner

[57] ABSTRACT

A fluidized bead bed including a conductive filter sheet for dissipating static electricity generated by the movement of the beads in the fluidized state. The filter sheet includes a conductive layer, a superimposed conductive net, or is interwoven with conductive fibers to conduct the static electricity to ground or to dissipate the static electricity as a heat loss or electromagnetic wave radiation.

11 Claims, 3 Drawing Figures

FLUIDIZED BEAD BED

FIELD OF THE INVENTION

This invention relates to an improvement in a fluidized bead bed for preventing bedsores on a patient lying thereon, wherein a filter sheet is adapted to cover the upper surface of a box-like tub filled with finely divided beads and compressed air is supplied to the interior of the tub from below to fluidize the beads to support the patient in a floating state.

BACKGROUND OF THE INVENTION

FIG. 1 illustrates a conventional bead bed 1 having a patient 2 lying thereon. The bed 1 generally comprises in combination a box-like tub 3 of sufficient size to accommodate the patient thereon and ceramic beads 4 filling the tub 3. The beads 4 are coated with resin, for example, and are made of finely divided glass having a specific gravity of approximately 2 to 3 and a particle size of 50 to 150.

An air permeable filter sheet 5 is fixedly attached to the peripheral edges of the tub 3 to cover the upper surface thereon. The mesh of the filter sheet 5 is smaller than the particle size of the beads 4. A plenum chamber 6 is located at the lower part of the tub 3 and a porous air diffusion plate 7 separates the plenum chamber 6 from the tub 3. An air blower 9 is provided within a machine housing 8 and the housing 8 also serves as a base for the bed. A conduit 10 is coupled between the air blower 9 and the plenum chamber 6 to supply compressed air thereto. A radiator 11 is provided in the conduit 10. Sheet press members 12 retain the sheet 5 at the peripheral edges of the tub 3.

In such arrangement, the compressed air is supplied from below through the plenum chamber 6 and the air diffusion plate 7 to the interior of the tub 3 by operation of the air blower 9. Once the interior of the tub 3 is fully supplied with the compressed air, the beads 4 contained in the tub 3 by means of the filter sheet 5, float under the influence of the compressed air. The specific gravity of the beads 4 is lowered to approximately 1.1 to 1.2 in such a condition and, thus, the patient 2 lying on the bed is supported in a floating state.

In a bead bed, contact pressure applied to the patient 2 is lessened significantly and the patient feels like he is floating in the air. After passing through the interior of the bed tub, the air passes through the sheet 5 into the interior of a room. It will be noted that the temperature of the air supplied from the air blower 9 is increased by 10° to 20° during the compression stroke. For this reason, a radiator 11 is provided in the conduit 10.

A bead bed arrangement has the advantage that when used for medical purposes, the effectiveness of treatment is improved by supplying the air in a constant manner while restraining application of contact pressure to the affected part of the patient suffering from a burn, for example. Bedsores are prevented by lessening the contact pressure between the bed and the patient.

The filter sheet adapted to cover the upper surface of the bed tub 3 is generally stained with the patent's body fluids. The filter sheet is usually made from a fabric woven of synthetic fiber such as polyester resin and the like, which is excellent in washability and durability. When the beads float under the influence of the air during operation of the bed, static electricity is likely to occur due to friction between the beads and between the beads and the filter sheets. Further, it has been found that the static electricity thus generated may reach 12 to 20 KV by actual measurement. As a result, an electric shock may be imparted to a nurse or attendant in charge of the patient and to the patient himself when he leaves and returns to his bed. An electric shock of this magnitude is not only painful but may also cause critical damage to the patient, particularly to a patient suffering from heart diseases.

OBJECTS AND SUMMARY OF THE INVENTION

An object of the present invention is a fluidized bead bed that is safe to use.

Another object of the present invention is a fluidized bead bed that safely dissipates static electricity.

A further object of the present invention is a fluidized bead bed that does not render shocks from static electricity discharge.

These and other objects are attained by a fluidized bead bed comprising a tub having an upper opening, a plurality of beads in the tub, a filter sheet covering the opening for preventing the beads from passing through the opening, and means for supplying compressed air to the tub to fluidize the beads therein, the filter sheet having conductive means for discharging static electricity generated by the movement of the beads in the fluidized state.

BRIEF DESCRIPTION OF THE DRAWINGS

The manner in which the above objects and other objects, features, and advantages of the present invention are obtained, as well as the invention itself, will be more readily understood with reference to the description below and the drawings, wherein.

DETAILED DESCRIPTION

Figure 2:
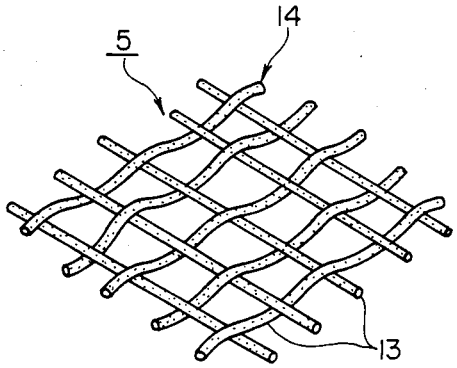
FIG. 2 is an enlarged segmentary view of an embodiment of the filter sheet of the present invention.
Figure 3:
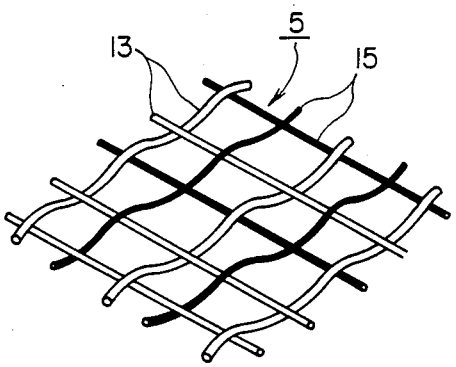
FIG. 3 is an enlarged segmentary view of a second embodiment of the filter sheet of the present invention.

FIGS. 2 and 3 are enlarged segmentary views of filter sheets constructed according to two different embodiments of the present invention. In the embodiment of FIG. 2, metal, such as aluminum or tin, is deposited on the surface of the fabric woven of synthetic fibers 13, e.g., polyester and the like, by a method of vacuum metallizing. This does not cause deterioration in air permeability and flexibility of the fabric. The conductive layer 14 is from approximately 1 to several microns in thickness.

Figure 1:
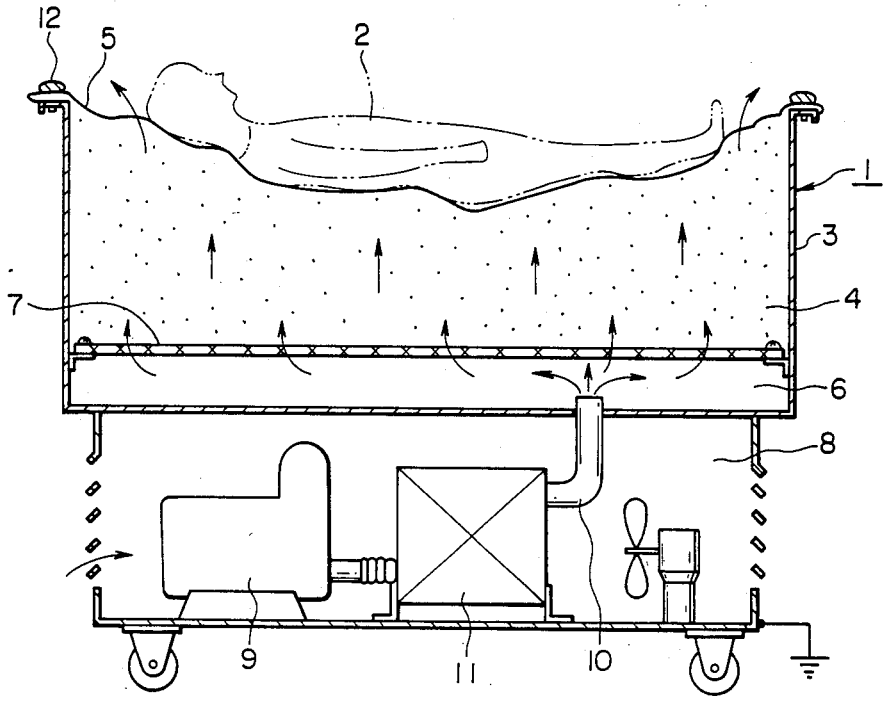
FIG. 1 is a sectional view of a fluidized bead bed.

After the conductive filter sheet 5 is laid over the upper opening of the bed tub 3 as shown in FIG. 1, the filter sheet 5 is connected electrically with the bed tub 3 which is, in turn, grounded through metal sheet press members 12. Static electricity generated by friction due to fluidization of the beads in the tub when the bed is under operative conditions, is directed through the conductive layer 14 on the filter sheet 5 to ground. Thus, no electrical shock due to static electricity is imparted to someone coming in contact with the bed.

FIG. 3 shows another embodiment wherein the filter sheet 5 is a fabric woven from synthetic fibers 13 and conductive fibers 15. The conductive fibers 15 are flexible, for example thin wires or carbon fibers, and are woven vertically and transversely at suitable intervals.

In this embodiment as well, static electricity is directed through the conductive fibers 14 to ground.

In another embodiment, the filter sheet 5 may be constructed in such a manner that a net woven of flexible conductive materials, such as thin wires or carbon fibers, is superimposed on the surface of a fiber woven of synthetic fiber, for example, the underside of the filter sheets.

In the respective embodiments as described above, the filter sheet 5 is connected electrically with ground so as to discharge static electricity. Ground connections, however, may not be obtainable under certain circumstances and locations. In such situations, however, the conductive layer, conductive fiber, and conductive net in the respective embodiments will consitute a closed circuit in the form of a network on the whole surface of the filter sheet 5 and the static electricity will flow in this closed circuit. Hence, the static electricity will be dissipated as a heat loss or electromagnetic wave and the occurrence of an electrical shock will be substantially prevented as in the above mentioned grounded constructions.

As described hereinabove, according to the present invention, the filter sheet is rendered conductive to dissipate frictional static electricity arising from fluidization of the beads when the bed is under operative conditions. Hence, no electrical shock is imparted to a person or object coming into contact with the bed, thereby improving the safety of the fluidized bead bed.

It should be understood that the present invention is not limited to the particular embodiments described, but rather is susceptible to modifications, alterations, and equivalent arrangements within the scope of the appended claims.

What is claimed is:

1. A fluidized bead bed comprising:

a bed tub having an upper opening;

a plurality of beads in said tub;

means for supplying comprssed air to said tub to fluidize said beads therein; and a filter sheet covering said upper opening of said bed tub for preventing said beads from passing through said opening, said filter sheet having conductive means in electrical contact with said beads for discharging static electricity generated by bead friction resulting from movement of said beads when fluidized.

2. A fluidized bead bed according to claim 1, wherein said conductive means of said filter sheet is grounded.

3. A fluidized bead bed according to claim 1, wherein said conductive means comprises a conductive layer deposited on the surface of said filter sheet.

4. A fluidized bead bed according to claim 1, wherein said filter sheet comprises a fabric woven from synthetic fibers and wherein said conductive means comprises conductive fibers interwoven with said synthetic fibers.

5. A fluidized bead bed according to claim 1, wherein said conductive means comprises a net of conductive material superimposed on said filter sheet.

6. A fluidized bead bed according to claim 4, wherein said conductive fibers comprise metallic wires.

7. A fluidized bead bed recording to claim 4, wherein said conductive fibers comprise carbon fibers.

8. An air-permeable filter sheet for use on a fluidized bed to cover an opening in a tub containing a plurality of fluidizable beads to prevent the beads from passing through the opening when the beads are in a fluidized state, the filter sheet comprising:

a woven synthetic fiber sheet; and conductive means on said synthetic fiber sheet for dissipating static electricity generated by the movement of the beads in the fluidized state.

9. A filter sheet according to claim 8, wherein said conductive means comprises a conductive layer deposited on said fiber sheet.

10. A filter sheet according to claim 8, wherein said conductive means comprises conductive fibers interwoven in said synthetic fiber sheet.

11. A filter sheet according to claim 8, wherein said conductive means comprises a net of conductive material superimposed on said synthetic fiber sheet.

* * * * *